United States Patent [19]

Takahashi

[11] 4,248,524

[45] Feb. 3, 1981

[54] METHOD OF AND APPARATUS FOR STABILIZING ELECTROPHOTOGRAPHIC IMAGES

[75] Inventor: Toru Takahashi, Tokyo, Japan

[73] Assignee: Canon Kabushiki Kaisha, Tokyo, Japan

[21] Appl. No.: 922,272

[22] Filed: Jul. 6, 1978

[30] Foreign Application Priority Data

Jul. 11, 1977 [JP] Japan ..... 52-82737
Jul. 20, 1977 [JP] Japan ..... 52-86954
Jul. 29, 1977 [JP] Japan ..... 52-91128

[51] Int. Cl.[3] ..... G03G 15/00

[52] U.S. Cl. ..... 355/14 E; 355/14 D; 355/14 CH; 355/77; 430/31

[58] Field of Search ..... 355/14, 3 DD, 67–69, 355/3 R, 3 CH, 77; 96/1 R; 118/7; 427/19; 250/324, 325; 430/31

[56] References Cited

U.S. PATENT DOCUMENTS

| | | | |
|---|---|---|---|
| 2,956,487 | 10/1960 | Giaimo | 355/14 |
| 3,604,925 | 9/1971 | Snelling | 250/49.5 ZC |
| 3,700,323 | 10/1972 | Guyette et al. | 355/14 X |
| 3,788,739 | 1/1974 | Coriale | 355/3 R X |
| 3,934,141 | 1/1976 | Vargas | 250/325 |
| 3,944,354 | 3/1976 | Benwood et al. | 355/14 X |
| 4,000,944 | 1/1977 | Fraser | 355/14 |
| 4,026,643 | 5/1977 | Bergman | 355/3 DD |

*Primary Examiner*—R. L. Moses
*Attorney, Agent, or Firm*—Fitzpatrick, Cella, Harper & Scinto

[57] ABSTRACT

This specification discloses a method of and an apparatus for controlling electrophotographic images comprising the steps of detecting the contrast voltage between the surface potentials of the light and dark regions of an electrostatic image formed by the electrophotographic image formation process by taking the difference therebetween, modifying the charging conditions so that the detected contrast may assume a predetermined value, and realizing the substantial background region potential at a predetermined level which would not create fog when said electrostatic image is developed into a visible image, substantially without varying the modified contrast.

20 Claims, 43 Drawing Figures

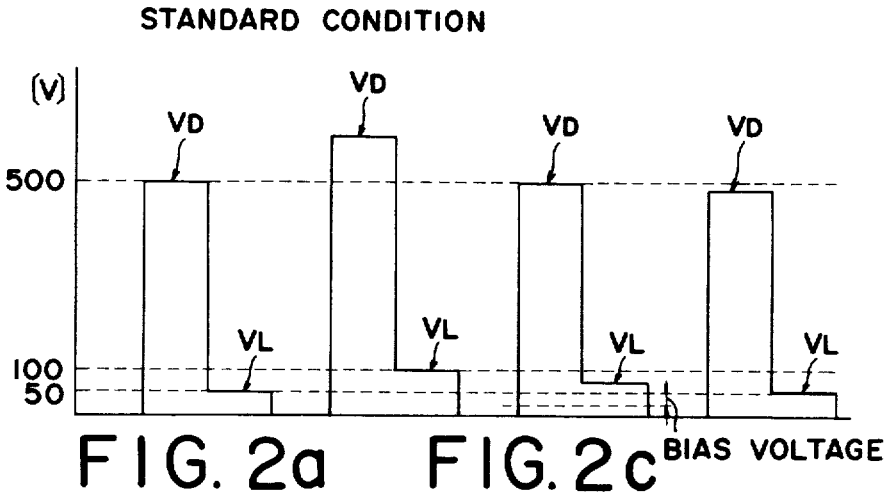
FIG. 2a FIG. 2c
FIG. 2b FIG. 2d
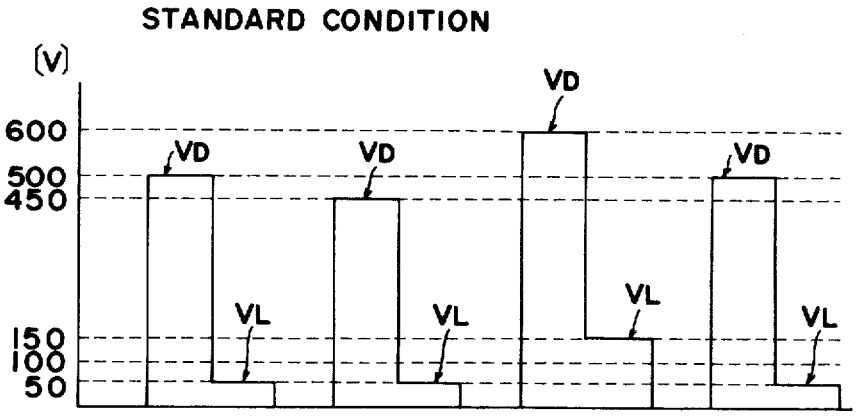
FIG. 2e FIG. 2g
FIG. 2f FIG. 2h

METHOD OF AND APPARATUS FOR STABILIZING ELECTROPHOTOGRAPHIC IMAGES

BACKGROUND OF THE INVENTION

1. Field of the Invention

This invention relates to a method of and apparatus for stabilizing images in electrophotography. More particularly, it relates to a method of and apparatus for measuring the surface potential of light and dark regions of an electrostatic image and detecting the difference or contrast between said surface potentials to thereby stabilize the image.

2. Description of the Prior Art

It is well known that electrophotography is a method whereby charge and a light image are applied to a photosensitive medium to form thereon an electrostatic latent image corresponding to the light image and imparting powder or liquid developer to such a latent image to visualize the latent image. This method has been widely put into practice as office copiers. However, the image formed by the machine may be unstable due to various factors and are not sufficiently satisfactory to the users. As typical factors for the unstability of the image, mention can be made of the deterioration of the photosensitive medium and fluctuations of charging, usually of corona charger due to temperature and humidity. These fluctuations can be detected by measuring the surface potentials in the step of electrostatic image formation which is an intermediate step of the image formation process, and it is known to change the various conditions for the electrostatic image formation in accordance with the detection signal to thereby form a stable electrostatic image.

For example, U.S. Pat. No. 2,956,487 discloses a method in which a probe is disposed in opposed relationship with latent image to thereby effect sensing signal which is a function of the color value of the latent electrostatic image area to thereby stabilize the developed image. U.S. Pat. No. 3,604,925 discloses an apparatus for automatically controlling the amount of electrostatic charge applied to a plane by controlling the potential applied to a corona wire. U.S. Pat. No. 3,788,739 discloses measurement of the surface potential by a probe which is positioned only in the position of the area which is always light struck, and comparison of the surface potential to a fixed reference in order to provide a control signal for compensation in an electrophotographic reproduction device. Further, U.S. Pat. No. 4,000,944 discloses a built-in electrode at the end of a photoreceptor and a probe disposed in opposed relationship therewith to thereby detect the amount of charging effected by a charger and to control so that the charge may be a desired charge on the drum photoconductive surface.

None of such prior art techniques is directed to the detection of the surface potentials of light and dark regions of an electrostatic image and detection of the difference between these surface potentials to thereby directly detect the contrast of the electrostatic image.

In our copending U.S. Patent Application Ser. No. 832,944 (German Patent Application No. P27 41 713.6; British Patent Application No. 38136/77; French Patent Application No. 77/28016), there is disclosed a method of stabilizing an electrostatic latent image which includes the steps of measuring the dark region potential and the light region potential on the photosensitive medium, comparing the thus measured values with respective predetermined reference potential of the light and dark regions, and when the differences thereof are not within the allowable predetermined ranges, then controlling the necessary factors such as energy source of chargers.

SUMMARY OF THE INVENTION

It is an object of the present invention to provide a method of controlling electrophotographic image which is improved over the above-described prior art techniques and the prior application.

It is another object of the present invention to provide a method of controlling electrophotographic image which comprises detecting surface potentials of light region of an electrostatic image bearing medium (when the image original to be reproduced is document, the background portion thereof) and dark region (when image original to be reproduced is a document, the image bearing portion thereof which is usually to be developed into a visible image) and taking the difference between the so detected surface potentials to obtain the contrast of the electrostatic image, the varying necessary variables so that the contrast may assume a preset value.

It is still another object of the present invention to provide a method of controlling electrophotographic image which comprises detecting the contrast potentials of light and dark regions of an electrostatic image bearing medium, adjusting the same to a predetermined value, substantially without changing such contrast potential, realizing the substantial background region potential to a predetermined potential which would not create fog when the electrostatic image is developed into a visible image.

It is yet another object of the present invention to provide a method of controlling electrophotographic image which comprises the steps of forming an electrostatic image corresponding to light and dark regions by an electrostatic image formation process including the charging and exposure steps, measuring the light region and the dark region potential, taking the difference between the light region potential and the dark region potential to obtain the electrostatic contrast and modifying the charging conditions in accordance with the value of the contrast to thereby render the electrostatic contrast to a predetermined value, forming an electrostatic image corresponding to the light or the dark region under the modifying conditions, measuring the potentials of the light or dark regions, and controlling the bias voltage during development in accordance with the potential of the light or the dark region.

It is a further object of the present invention to provide a method of controlling electrophotographic image which comprises the steps of forming an electrostatic image by the electrostatic image formation method including the primary charging and the secondary charging or discharging step and image light application step, measuring the light region and the dark region potential of the electrostatic image, taking the difference between the two potentials to thereby calculate the electrostatic contrast and modifying the primary charging condition in accordance with the value of the contrast to thereby render the electrostatic contrast to a predetermined value, forming an electrostatic image under the new conditions, measuring the light region or the dark region potential of the electrostatic image, and controlling the secondary charging or discharging conditions in accordance with the measured value to thereby render the light region or the dark region potential to a predetermined value.

It is a further object of the present invention to provide a method of controlling electrophotographic image which comprises the steps of forming an electrostatic image by the electrostatic image formation method including the primary charging and the secondary charging or discharging step and a light image application step, measuring the light region and the dark region potential of the electrostatic image, taking the difference between the two potentials to thereby calculate the electrostatic contrast and modifying the primary charging condition in accordance with the value of the contrast to thereby render the electrostatic contrast to a predetermined value, forming an electrostatic image under the new conditions, measuring the light region or the dark region potential of the electrostatic image, controlling the secondary charging or discharging conditions in accordance with the measured value to thereby render the light region or the dark region potential to a predetermined value, and controlling the amount of exposure so that a proper quantity of light may be imparted in accordance with the photosensitive medium in use.

It is a further object of the present invention to provide an apparatus for controlling electrophotographic image having surface potential measuring means suitable for the measurement of the surface potential of light or dark regions of an electrostatic image bearing medium.

A first feature of the present invention is that the contrast potential of the light and dark regions of an electrostatic image bearing medium is detected and in order to render it to a predetermined value, a first modification is effected in the electrostatic image formation process. A second feature of the present invention is that when the electrostatic image is developed into a visible image at a subsequent step, the aforementioned contrast is maintained at an allowable predetermined value. The potential at the background portion is maintained at a predetermined value during the development in order to eliminate the deposition of developer onto the background portion, namely, the undesirable phenomenon commonly known as fog. There are several equivalent methods which may be used to set and maintain the background portion potential substantially at a predetermined value during the image development. For example, it is an equivalent method in the process with the first step of the present invention as the premise to hold the surface potential of the light region (background portion) at a predetermined value while the contrast is maintained at a predetermined value as previously noted, or to adjust the quantity of light during the image light application, or to control the developing bias voltage during image development.

Other objects and features of the present invention will become apparent from the following detailed description of some embodiments of the invention taken in conjunction with the accompanying drawings.

BRIEF DESCRIPTION OF THE DRAWINGS

FIGS. 2*a* to 2*h* graphically illustrate the manner in which surface potential is controlled according to the embodiment of FIGS. 1*a*–1*d*.

FIGS. 21*a* to 21*e* are cross-sectional views showing some examples of the configuration of the rotary electrode applied in the device of FIG. 19.

DESCRIPTION OF THE PREFERRED EMBODIMENTS

Embodiment 1

Figure 1A:
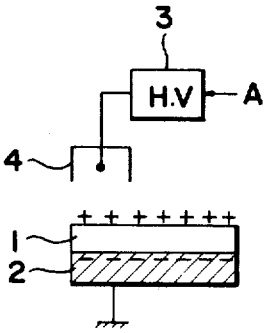
FIGS. 1*a* to 1*d* illustrate an embodiment of the present invention.

Referring to FIGS. 1 to 6, there is shown a first embodiment of the present invention which includes the method of applying a bias voltage to a developing electrode during development in order to realize a background portion potential at a predetermined potential substantially eliminating the fogging of the background portion during the development.

FIGS. 1*a* to 1*d* illustrate the electrostatic image formation process and the developing step. Reference numeral 1 designates a photoconductor such as selenium or the like applied or joined to a conductive substrate 2 such as aluminum or the like grounded. These two together form a two-layer photosensitive plate. Such photosensitive plate may also be in the form of a drum or belt.

FIG. 1*a* shows the step of electrically charging the photosensitive plate by imparting corona discharge to the surface of the photosensitive plate from a corona charger 4 connected to a high voltage source 3.

Subsequently, in the image light application step shown in FIG. 1*b*, an original 6 is illuminated by a light source 5 and the light passed through the original is projected onto the photosensitive plate to form an electrostatic image corresponding to the light and dark pattern of the original. Of course, the image formation may also be effected by using reflected light instead of the passed light.

Figure 1B:
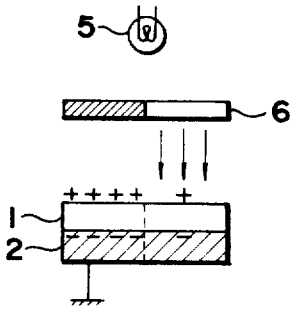
Figure 1C:
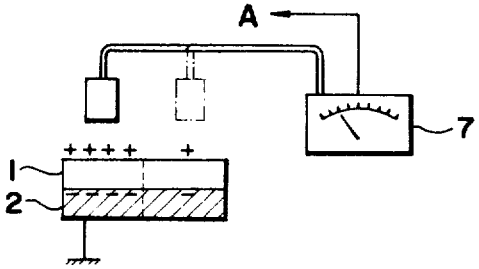

In the common electrophotography, above-mentioned step is followed by developing step and so forth, but according to the present invention, there is the step of measuring the surface potentials of the photosensitive plate by the use of a measuring device 7 to be described, as shown in FIG. 1c, thereby detecting the difference or contrast between the surface potentials corresponding to the light and dark regions of the original. Description will now be made of the example case where the standard condition as the target value when an electrostatic image is formed by the use of the above-described photosensitive plate is set to the surface potential of the photosensitive plate corresponding to the dark region of the original (hereinafter referred to as the dark region potential $V_D$) $V_D=500$ V and the surface potential of the photosensitive plate corresponding to the light region of the original (hereinafter referred to as the light region potential $V_L$) $V_L=500$ V, and the electrostatic contrast is set to $V_C=V_D-V_L=450$ V. Such standard condition is shown in FIG. 2a.

Now, if FIG. 1c, when the surface potential has been actually measured, it is assumed that $V_D=600$ V (as measured by the detector positioned as shown in solid lines), $V_L=100$ V (as measured by the detector positioned as shown in dotted lines) and therefore, $V_C=500$ V, as shown in FIG. 2b.

The reasons why the so measured dark region potential is higher than the standard condition $V_D=500$ V may be (1) the high voltage source (HV) is higher than the standard;
(2) the characteristic of the photosensitive medium is abnormal; or
(3) Corona discharge is actively taking place due to the low humidity or high temperature.

If any of these reasons applies, it is simplest to lower the high voltage (HV) in order to individually correct the dark region potential to the above-mentioned standard value. Thus, the charging high voltage (HV) is lowered in accordance with the result of measurement for the purpose of adjusting only the dark region potential, for example. More specifically, charging is effected with the charging high voltage (HV) lowered from the step of FIG. 1c (shown by arrow A) to the step of FIG. 1a as indicated by arrow A, and then the exposure step of FIG. 1b and the surface potential measuring step of FIG. 1c are repeated to measure the light region and the dark region surface potential under the above new charging conditions. The results is as shown in FIG. 1c, where the dark region potential has becomes a predetermined value. That is, $V_D$ and $V_L$ are in the relations that $V_D=500$ V and $V_L=80$ V (and thus, it is assumed that $V_C=420$ V). In this case, however, the light region potential is higher than the standard value.

The reason why the light region potential is higher than the standard value may be:

(1) the charging voltage is high;
(2) the sensitivity of the photosensitive medium is low; or
(3) the quantity of light is insufficient. Therefore, if it is attempted to individually adjust the light region potential, the item (1) above is already adjusted for the adjustment of the dark region and readjustment thereof is undesirable and after all, increasing the quantity of light is simplest.

However, when the residual potential of the photosensitive layer is high, the light region potential whould sometimes not drop even if the quantity of light is increased. In such case, the light region potential is too high and when developed, even the light region permits deposition of developer thereon which undesirably results in the so-called background fog of copy.

Figure 1D:
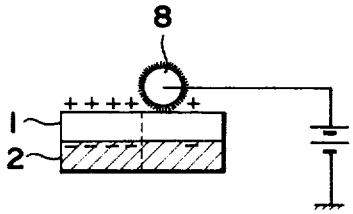
Figure 3:
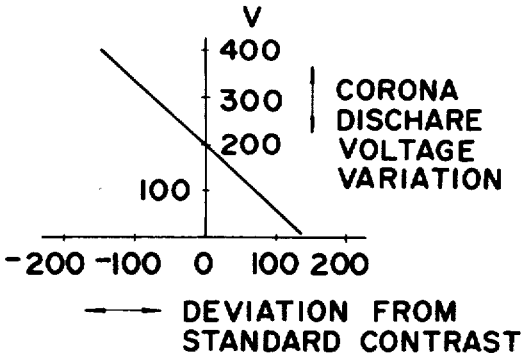
FIG. 3 is a conversion chart illustrating the compensation for the deviation from standard contrast by adjustment of the corona voltage applied.
Figure 4:
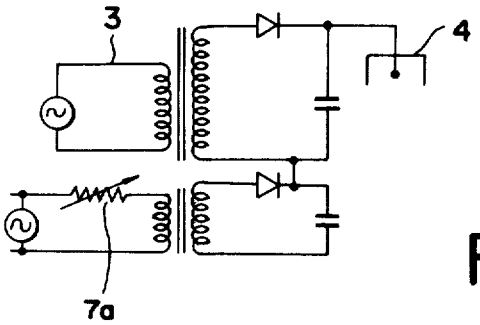
FIG. 4 is a diagram showing an example of the circuit for automatically controlling the corona voltage applied.

Therefore, when development is effected, correction is made in accordance with the difference between the above-mentioned light region potential and the standard light region potential and for this purpose, use is made of the method as shown in FIG. 1d which comprises applying a bias voltage to the developing electrode 8.

For example, when, as shown in FIG. 2c, the dark region potential is 500 V (proper) and the light region potential is 80 V, if a bias voltage of +30 V is applied to the developing electrode (shown dotted), there is obtained the same effect as that when the substantially sensitizing potential is generally lowered by 30 V (FIG. 2d). By doing so, the light region potential becomes substantially 50 V (proper) to eliminate background fog. On the other hand, in this case the dark region potential $V_D$ is lowered substantially by 30 V, so that there is a disadvantage that the dark region potential is deviated from its optimal condition $V_D=500$ V. If the charging voltage is again increased to modify this, the dark region potential becomes proper but the light region potential is also moved. If this is again modified by the method of applying a bias voltage, the dark region potential will be deviated from its proper value as noted above. In this manner, if it is attempted to control the light region or the dark region potential individually according to the prior art, there is the necessity of infinitely modifying the charging voltage and the developing bias voltage.

The present invention drastically improves such point and pays attention to that:

(i) The charging voltage of the high voltage source is varied in such a manner that $V_L$ and $V_D$ are varied simultaneously so that the difference between $V_L$ and $V_D$, namely, the contrast $V_C=V_D-V_L$ is varied to provide a predetermined contrast (standard contrast).

(ii) In the application of the developing bias voltage, $V_D$ and $V_L$ are varied out the contrast $V_C=V_D-V_L$ can be maintained substantially constant, and the invention is characterized by (1) premeasuring $V_D$ and $V_L$ under the standard condition taking into account the photosensitive plate used, the electrostatic latent image formation process and the developing method, and precalculating the reference electrostatic contrast $V_C=V_D-V_L$;
(2) next, actually applying the electrostatic image formation process to the photosensitive plate and immediately thereafter, measuring $V_D$ and $V_L$ to calculate $V_C=V_D-V_L$ and modify the charging voltage so that $V_C$ becomes the reference constant value set above;
(3) again effecting the electrostatic image formation process under the modified charging conditions and measuring $V_D$ or $V_L$; and
(4) controlling the bias voltage applied during development so that $V_D$ or $V_L$ substantially assumed a predetermined value.

By doing the foregoing, both $V_D$ and $V_L$ can be rendered to predetermined values in the shortest time.

In the case of the above-mentioned standard conditions ($V_D=500$ V, $V_L=50$ V, $V_C=450$ V, see FIG. 2e), if the surface potentials measured, for example, by the steps of FIGS. 1a-1b-1c are $V_D=450$ V and $V_L=50$ V, then $V_C=450-50=400$ V. To render such contrast to the standard value 450 V, the charging voltage to be applied is modified by a method which will be described. The present invention effects such modification and does not modify the dark (or light) region to the standard potential individually. According to the present invention, such modification has been effected to render the contrast constant and then, image light has been applied as shown in FIG. 1*b*, whereafter the surface potential has been measured as in FIG. 1*c*, whereby as shown in FIG. 2*g*, $V_D=600$ V and $V_L=150$ V has been obtained. Thus, contrast is maintained at $V_C=450$ V.

Next, when 100 V was applied as the bias voltage to the developing electrode during the developing step shown in FIG. 1*d*, substantially proper values have been obtained such as $V_D=500$ V, $V_L=50$ V and thus, $V_C=450$ V, as shown in FIG. 2*h*.

Figure 8:
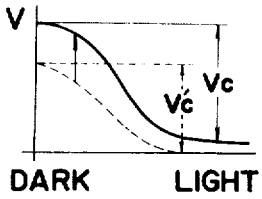
FIGS. 8 to 10 schematically illustrate the manner in which the surface potential of a photosensitive medium applied in the second embodiment is controlled.

The measurement of the initial $V_D$ and $V_L$ is effected under predetermined standard conditions (e.g. corona charge applied 6.2 KV and a predetermined amount of exposure), and then the conversion chart as shown in FIG. 8 in which the deviation from the standard contrast $V_C$ and the amount of variation of the corona charge applied are obtained with respect to the photosensitive medium in use is prepared, whereafter a predetermined contrast is preferably obtained by a single modification of the charging voltage source (HV, see FIG. 1*a*). Also, it is possible to automatically vary the voltage supplied from the source 3 as shown in the electric circuit of FIG. 4, for example, in order to automatically control the amount of variation of the voltage applied to the corona discharger 4 in accordance with the output of a surface potentiometer 7*a*.

An example of the present invention will now be described.

Two photosensitive plates $P_A$ and $P_B$ are chosen. Standard corona voltage (6.2 KV) is applied to these photosensitive plates $P_A$ and $P_B$ in the step of FIG. 1*a*. Application of image light as shown in FIG. 1*b* is effected from, for example, a light source of 20 lux. Surface potentials of the light and dark region are measured by the measuring device shown in FIG. 1*c*, and the difference therebetween is taken to provide an electrostatic contrast. The specific measuring device for surface potentials will later be described.

Figure 5:
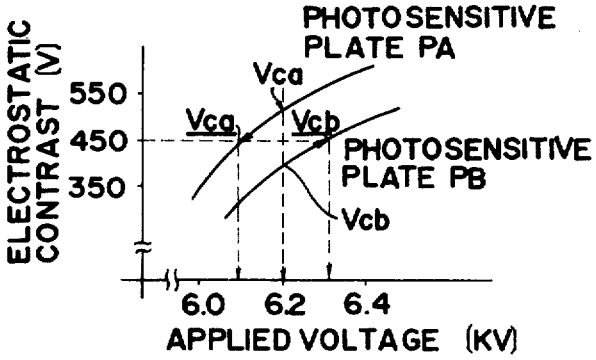
FIGS. 5 and 6 are conversion charts illustrating the compensation for the deviation from standard contrast by variation in charging bias voltage.

If the electrostatic contrasts $V_{ca}$ and $V_{cb}$ on the photosensitive plates $P_A$ and $P_B$ used are 510 V and 390 V, respectively, as shown in FIG. 5, applied voltage-electrostatic contrast characteristics of the two photosensitive plates are empirically pre-obtained as shown in Figure and this is prepared in the form of the shown conversion chart. From this chart, respective modification voltages $HV_a$ and $HV_b$ are applied to the corona discharger in order to render $V_{ca}\rightarrow V_{ca}$(450 V) and $V_{cb}\rightarrow V_{cb}$(450 V).

Figure 6:
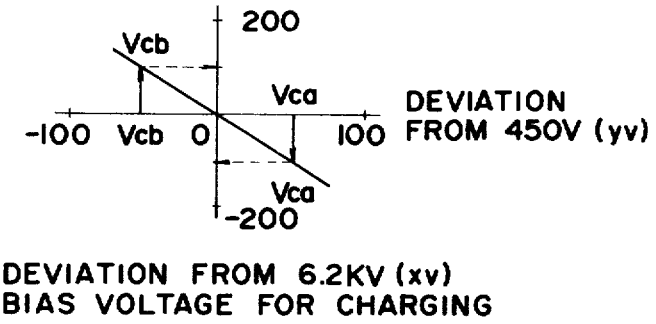

As will be seen from the experiments of these photosensitive plates $P_A$ and $P_B$, the variation ($\Delta V_c$) of the electrostatic contrasts of the photosensitive plates $P_A$ and $P_B$ for the variation ($\Delta V$) in the vicinity of the voltage (6.2 KV) applied to the corona discharger is substantially linear and considered to be in proportional relationship which can be approximated, and therefore, if the constant of proportion thereof is k, the relation that $k=\Delta V_c/\Delta V \therefore V_C=k\ V$ is obtained. From this relation, the graph of FIG. 6 can be depicted in which the abscissa represents the deviation (yV) from the standard electrostatic contrast 450 V and the ordinate represents the deviation (xV) from the applied source voltage 6.2 KV. This graph can reasonably apply also to other photosensitive plate of the same type as the photosensitive plates $P_A$ and $P_B$ used in the experiments, as the graph indicating the relation between x and y. Thus, the graph of FIG. 6 provides a conversion chart of the charging bias voltage in which the abscissa represents the deviation (yV) from the standard contrast (450 V) and the ordinate represents the bias voltage (xV) from the standard applied voltage (6.2 KV) and therefore, from this chart, the charging bias voltage to be applied may be determined primarily.

By the use of the above-described chart and by a single modification of the applied voltage, it is possible to render the electrostatic contrast to a predetermined value and therefore, after this charging step, through the image light application step shown in FIG. 2*b* and in the measuring step shown in FIG. 1*c*, the surface potential of the photosensitive plate corresponding to the light or the dark region of the light image is measured. If the value of the dark region potential $V_D$ or the light region potential $V_L$ is detected as to its deviation from the standard dark region or light region potential, the bias voltage to be applied to the developing electrode is determined primarily because such deviation is corrected. Therefore, by applying this bias voltage to the developing electrode 8 shown in FIG. 1*d* to thereby effect development, it is possible to develop the electrostatic image having the standard light and dark region potentials and the standard electrostatic contrast.

This embodiment provides an electrophotographic control method which comprises the steps of forming electrostatic images of light and dark regions by the electrostatic image formation process including the charging and exposure steps, measuring the light and the dark region potential and providing an electrostatic contrast, modifying the charging conditions in accordance with the value of the electrostatic contrast to thereby render the electrostatic contrast to a predetermined value, forming the electrostatic images of the light or dark regions under the modified conditions, measuring potentials of the light or dark regions, and controlling the bias voltage during development in accordance with the light or the dark region potential, and has the following excellent advantages:

(1) By a very simple operation, both $V_D$ and $V_L$ can be rendered to predetermined values, thus ensuring stable image formation.

(2) Since the value of $V_L$ is not widely controlled by the quantity of light, V-E characteristic (quantity of light and voltage characteristic) can be utilized and the resultant image is of excellent quality.

(3) Even if the intensity of the corona discharge is varied by temperature and humidity, this is also modified and therefore, images can be formed stably against variations in environmental conditions.

(4) Even if the photosensitive plate is deteriorated to decrease the contrast, this can easily be corrected to a certain extent.

The present embodiment has been described with respect to the so-called Carlson process using two-layer construction, ,ut it is equally applicable to other process using three-layered photosensitive plate and also effectively applicable to the process in which the contrast ($V_C=V_D-V_L$) is varied by the intensity of the corona discharge.

FIGS. 7 to 17 show a second embodiment of the present invention. This embodiment is a method using a three-layered photosensitive plate and applicable to the electrostatic image formation process having secondary charging or discharging step. The embodiment includes a method of controlling the secondary charging or discharging condition to realize the background portion potential to a predetermined level which does not create fogging of the background during the above-described development.

Applicable as such an electrostatic image formation process are the methods as disclosed in U.S. Pat. Nos. 3,666,363; 3,734,609, 4,071,361; etc. and other methods.

Figure 7A:
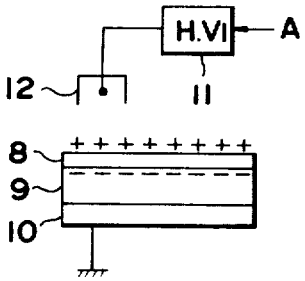
FIGS. 7*a* to 7*d* illustrate a second embodiment of the present invention.
Figure 7B:
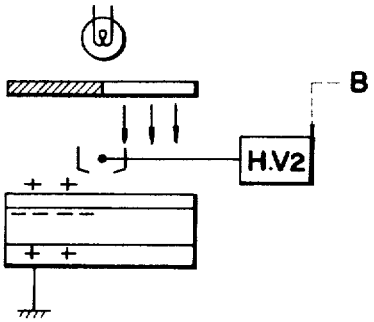

In FIG. 7*a*, reference character 8 designates a transparent surface insulating layer, 9 a photoconductive layer and 10 a conductive substrate, these basically forming a three-layered photosensitive plate. Charge is imparted to such photosensitive plate by imparting corona discharge to the surface insulating layer from a corona discharger 12 connected to a high voltage source 11 (HV1). At this time, by the injection of charge from the substrate into the photoconductive layer or by uniform application of light simultaneously with the charging, charge opposite in polarity to the surface charge forms a charge layer in the interface between the insulating layer 8 and the photoconductive layer 9. Next, in FIG. 7*b*, DC corona discharge opposite in polarity to the primary charge or AC corona discharge is imparted simultaneously with the application of image light, thus effecting secondary charging or discharging. When this occurs, some of the surface charge in the dark region is removed but some of that surface charge remains under the influence of the interface charge. In the light region, the charging or discharging completely or slightly to the opposite polarity occurs in accordance with the secondary charging or discharging.

Figure 7C:
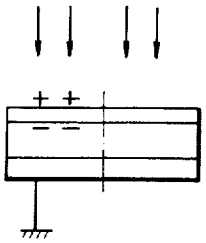
Figure 7D:
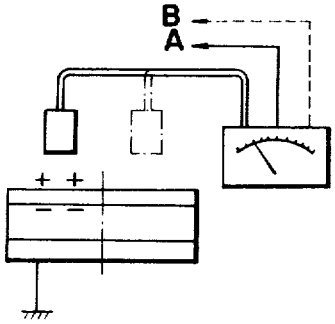

Next, as shown in FIG. 7*c*, light is applied to the entire surface of the photosensitive plate to remove any electric field within the photoconductive layer. In this manner, the surface potential is measured as shown in FIG. 7*d*. Description will now be made by taking as an example the case where the secondary discharging is effected. Now, although the standard conditions should be $V_D=500$ V, $V_L=-50$ V ($V_C=550$ V), for example, the actual measurement proved to be $V_D=400$ V, $V_L=0$ V ($V_C=400$ V). Therefore, the steps of FIGS. 7*a*–7*d* have been repeated by increasing the primary charging voltage (HV1) to increase $V_D$, whereupon the following has been obtained:

$$V_D=500\text{ V } V_L=+50\text{ V } (V_C=450\text{ V})$$

Thus, the dark region potential has assumed the standard potential but the light region potential has deviated from the standard conditions. Therefore, the step has been repeated with the quantity of image light increased, whereupon only the following result has been obtained:

$$V_D=500\text{ V } V_L=+30\text{ V } (V_C=470\text{ V})$$

This has been found to be attributable to the fact that the secondary charging potential only has the discharging capacity of +30V irrespective of the quantity of light. Therefore, instead of increasing the quantity of light, the voltage (HV2) of the secondary discharging has been increased to obtain:

$$V_D=400\text{ V } V_L=-50\text{ V } (V_C=450\text{ V})$$

Thus, the light region has assumed the standard conditions, but the dark region has again deviated from the standard conditions.

As will be seen from the above fact, in the electrophotography using a photosensitive plate having a surface insulating layer, it is not possible simply to obtain a predetermined value of contrast by the method of individually modifying $V_D$ or $V_L$ as has heretofore been done. This is because the light region potential ($V_L$) is varied not only with light but also with charging condition and, because, if the charging condition is set only for the purpose of controlling the light region potential ($V_L$), the dark region potential cannot be controlled.

The inventor has studied the previously mentioned experiments in detail to find the following facts:

(1) varying the primary charging voltage (HV1) influences each of $V_D$, $V_L$ and $V_C(V_L-V_D)$;

(2) varying the secondary charging voltage (HV2) influences $V_D$ and $V_L$ but does not substantially influence $V_C(=V_L-V_D)$. However, this is not so strictly theoretically, but it can roughly be said although there is some influence on the $V_C$.

(3) Therefore, if the HV1 is first controlled to render the contrast $V_C$ to a predetermined value and HV2 is controlled to render $V_L$ to a predetermined value, both of $V_L$ and $V_C(=V_L-V_D)$ assume predetermined values since $V_C$ is not variable. Thus, both $V_D$ and $V_L$ assume their predetermined values.

In accordance with these facts, the inventor has obtained the result measurement $V_D=400$V, $V_L=0$V ($V_C=400$V) in the same step is that of FIG. 7 wherein the standard conditions should be $V_D=500$ V, $V_L=-50$ V ($V_C=550$ V), and this result is similar to the aforementioned experiment. Therefore, when the steps of a–d have been effected with the primary charging voltage (HV1) increased so as to render $V_C=550$V, the following has been obtained:

$$V_D=650\text{ V } V_L=100\text{ V } (V_C=550\text{ V})$$

Next, when the steps a–d have been again effected with the secondary discharging voltage (HV2) increased so as to render $V_L=-50$ V, the intended purpose has been achieved by obtaining the following:

$$V_D=500\text{ V } V_L=-50\text{ V } (V_C=550\text{ V})$$

An example of the control method according to the present embodiment will now be described.

First, the aim of this embodiment will be explained.

(a) As shown in FIG. 8, the image formation step is once effected and the resultant surface potential is measured to obtain electrostatic contrast ($V_C'=V_D-V_L$) and the primary charging voltage is adjusted so that the $V_C'$ assumes a predetermined standard value of contrast $V_C$.

Figure 9:
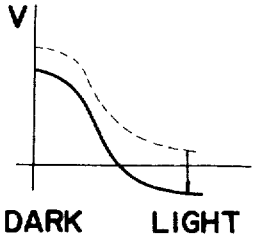

(b) Then, as shown in FIG. 9, secondary discharging voltage is controlled so that the light region potential $V_L$ is coincident with the standard conditions. This is based on the result of observation that even if the discharging voltage is varied, the electrostatic contrast is very little varied.

Figure 10:
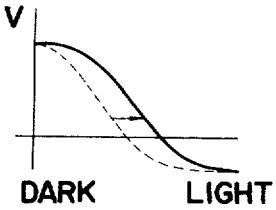

(c) Lastly, as shown in FIG. 10, sensitivity is adjusted to match the photosensitive medium in use. This is based on FIG. 10 in which neither of the electrostatic contrast and the light region potential are substantially varied even if the potential curve is parallel shifted. The procedure (c) above should preferably be carried out in the matching relationship with the photosensitive medium.

The specific manners in which the foregoing procedures (a), (b) and (c) are carried out will now be described.

Figure 11:
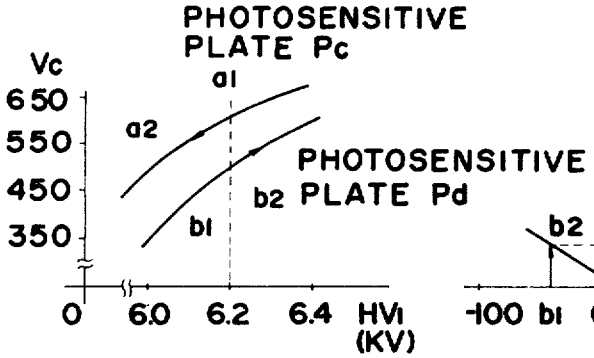
FIGS. 11 to 17 illustrate the steps of controlling the surface potential of the photosensitive medium applied in the second embodiment.
Figure 12:
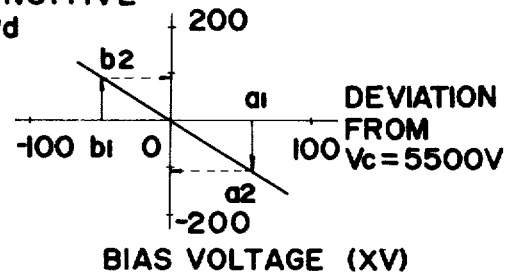

(a): First, the steps a–c shown in FIG. 7 are carried out and the light region surface potential of the resultant electrostatic image is measured. This surface potential measurement may be effected by the use of a conventional measuring device or other device which will further be described. The standard conditions are $V_D=500$ V, $V_L=-50$ V and $V_C=550$ V. As the primary charging voltage (HV1), corona discharger 12 is connected with a high voltage source 11 of 6.2 KV. It is assumed that when the corona discharge is at the standard corona discharge voltage 6.2 KV, as shown in FIG. 11, the electrostatic contrasts at $a_1$ and $b_1$ of the two photosensitive medium $P_C$ and $P_D$ used in experiment have been taken. In order to coincide these contrasts $a_1$ and $b_1$ with the standard contrasts $a_2$ and $b_2$ ($a_2=b_2=550$ V), a predetermined bias voltage (xV) is superposed on the primary voltage 6.2 KV. Since it can be assumed that the curves (FIG. 11) of the photosensitive mediums $P_C$ and $P_D$ are parallel lines in the necessary portions, if the conversion chart as shown in FIG. 12 is prepared as already described with respect to the first embodiment, the deviation from $V_L=550$ V and the bias voltage to be applied can be determined from such chart. Consequently, this bias voltage is applied to effect the primary charging and then, the steps b, c and d are again effected.

Figure 13:
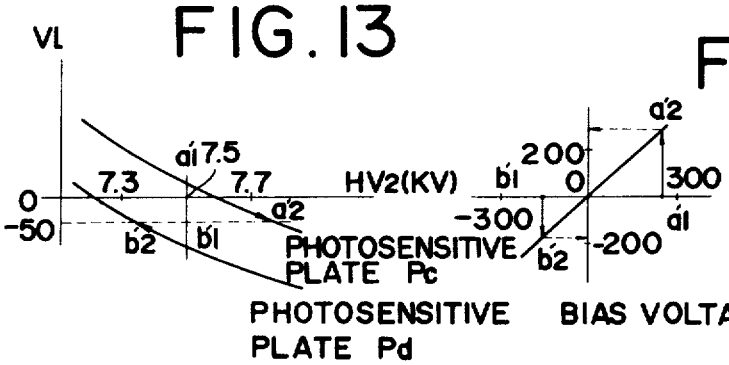
Figure 14:
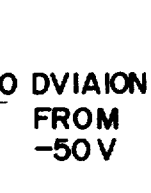
Figure 15:
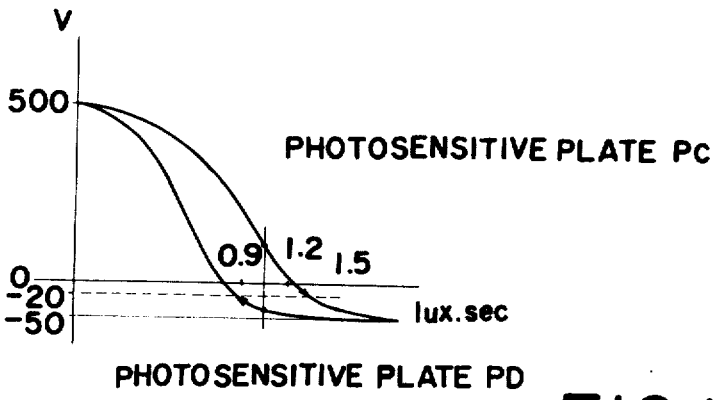

(b): In (a) above, the electrostatic contrast could be set so as to be constant, and now the light region surface potential is measured. This measurement is effected with an AC voltage of 7.5 KV applied as the standard secondary discharging voltage (HV2). The light region potentials as shown in FIG. 13 have been measured as to the photosensitive plates $P_C$ and $P_D$. In order for these light region potential to assume a predetermined value $-50$ V, $a_1$, and $b_1$, must be rendered to $a_{2'}$ and $b_{2'}$ ($a_{2'}=b_{2'}=-50$ V). In the same manner as already described, it can be assumed in FIG. 13 that the necessary portions of the curves of $P_C$ and $P_D$ are substantially parallel, the deviations of $a_{1'}$ and $b_{1'}$ from the standard light region potential ($-50$ V) and the bias voltage to be applied can be primarily determined as FIG. 12 is derived from FIG. 11, and this is prepared in the form of the conversion chart as shown in FIG. 14. The bias voltage (x'V) is derived from this chart and added to 7.2 KV, thus providing an AC source voltage.

(c): When the steps a–c of FIG. 7 are carried out with the bias voltage applied according to (a) and (b), the dark region surface potential should have become $V_D=500$ V with $V_L=-50$ V and $V_C=550$ V. At this time, the sensitivity of the photosensitive medium is irregular and the optimal quantity of light which would not create background fog during development differs from portion to portion, and this must be compensated for.

Therefore, the surface potential when the photosensitive medium is exposed to the standard quantity of light is measured and, in accordance with the deviation of that potential from the standard potential, the proper quantity of light to be applied to the photosensitive medium is calculated to vary the width of the exposure slit accordingly.

For example, assuming that the critical voltage of the light region which does not create background fog during development is $-20$ V, the quantity of light is corrected from the standard quantity of light so that this potential becomes the optimal quantity of light to the photosensitive plate.

Figure 16:
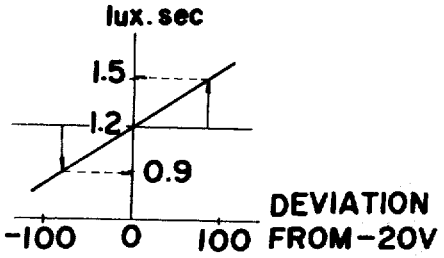
Figure 17:
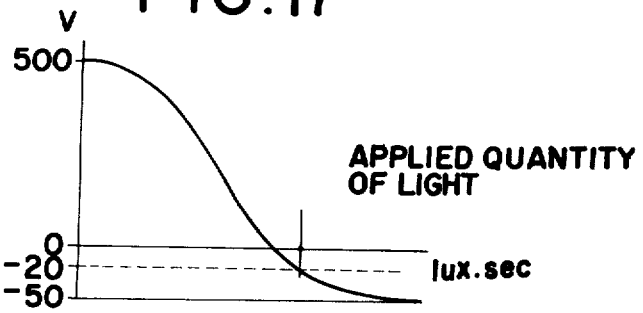

In the case of the above-described photosensitive plates $P_C$ and $P_D$, it has been empirically found that the variation in surface potential (ordinate) for the variation in amount of exposure (abscissa) in the electrostatic image formation step is as shown. The critical voltage of the light region is set so as to be $-20$ V when light of 1.2 lux·sec. is applied as the standard quantity of light, but when exposed to the light of 1.2 lux·sec., the photosensitive plate $P_C$ assumes a surface potential lower than $-20$ V and the photosensitive plate $P_D$ assumes a surface potential higher than $-20$ V and especially in the case of the latter, background for may occur during development. Therefore, the quantity of light to be applied is corrected from the standard quantity of light in dependence of the photosensitive plate. Thus, on the assumption that the variation in quantity of light versus the variation in potential in the vicinity of the standard quantity of light is linear, a chart for obtaining the quantity of light corresponding to the light region critical voltage as the amount of deviation from 1.2 lux·sec. during application of image light is prepared as shown in FIG. 16 by inferring from the standard photosensitive medium or statistically from the properties of a photosensitive medium. In addition, the amount of exposure is corrected so as to provide a proper quantity of light from the standard quantity of light (1.2 lux·sec.) in accordance with the deviation from $-20$ V.

As the result, the characteristic of the photosensitive plate is coincident with proper standard condition in all the given cases of the quantity of light.

By the method described above, the light and dark region potentials can be very simply rendered to predetermined values even in the electrophotography using a photosensitive plate having a surface insulating layer, and this may be considered to be a highly practical control method.

The present embodiment is effective in the case where electrostatic image is formed on a photosensitive medium having a surface insulating layer by at least two charging processes and application of image light, and utilizes the fact that the primary charging determines the contrast and the last charging or discharging affects the light region potential and therefore, it is effectively applicable to any of the process in which charging, discharging and exposure take place in succession and the process in which charging, discharging and exposure take place simultaneously. Also, instead of the above described control of the secondary charging or discharging, use may be made of the control by the developing bias as described with respect to the first embodiment.

Figure 18:
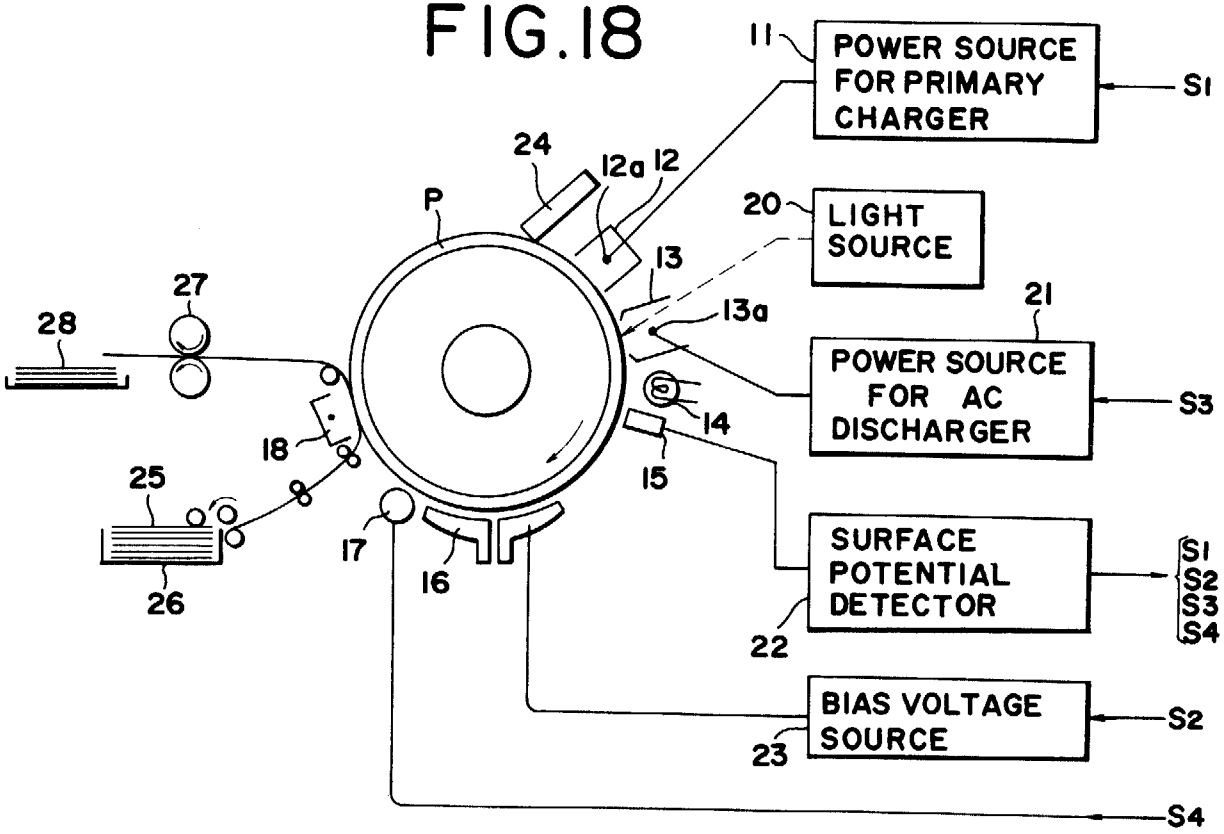
FIG. 18 schematically illustrates the construction of the electrophotographic apparatus for carrying out chiefly the second embodiment.

FIG. 18 schematically shows the construction of the apparatus for operating the second embodiment. The electrostatic image formation process in this apparatus is that which uses a photosensitive medium basically comprising a photoconductive layer and an insulating layer provided on a conductive back-up member and utilizes the process disclosed in U.S. Pat. No. 3,666,363. The photosensitive drum P comprising such a photosensitive medium shaped like a drum is rotatable in the direction of arrow by unshown drive means. This photosensitive medium is uniformly subjected to corona discharge from a primary charger 12 and then subjected to AC corona discharge from an AC discharger 13 while, at the same time, it is subjected to image light by exposure light source 20, whereafter the photosensitive medium is uniformly subjected to whole surface exposure from a lamp 14. In this manner, electrostatic latent image of high contrast is provided on the surface of the photosensitive drum. This electrostatic latent image is developed under the action of a developing electrode 16 with the aid of liquid developer containing toner particles, and the remaining developing liquid is squeezed out from the drum surface by a defogging and squeeze roller 17. Of course, the development may alternatively be effected by the use of dry developer composed of toner particles and magnetic carrier. The toner image so developed is transferred by transfer charge 18 onto transfer paper fed from a tray and passed through a fixing device 27 comprising a heating and pressure roller for fixation and discharged as a copy 28 into a discharge tray. After the image transfer, the toner remaining on the surface of the photosensitive medium is removed by a blade cleaner 24.

Designated by 11 is a voltage source for the primary charger shown in FIG. 7*a* and it applies a DC high voltage (HV1) to a corona wire 12*a*. Denoted by 21 is a voltage source for the AC discharger shown in FIG. 7*b* and it applies an AC discharging high voltage (HV2) to a corona wire 13*a*. Reference numeral 22 designates a surface potential detector having a probe 15 disposed in opposed relationship with the electrostatic image formed by such means and capable of measuring the surface potential of the high and dark regions of the light image. Denoted by 23 is a bias voltage source for applying bias voltage to a developing electrode 16.

The surface potential measuring device shown in FIGS. 1*c*, 7*d* and 18 may be the well-known one as disclosed in U.S. Pat. No. 3,944,354. This is a so-called vibratory electrode surface potential measuring device which comprises a rotatable noncircular electrode disposed in face-to-face relationship with the photosensitive plate and surrounded by a grounded shield member. This device utilizes the fact that the amount of charge induced in the electrode when brought near the photosensitive plate having a surface potential is varied in accordance with the distance between the surface of the photosensitive plate and the electrode, and measures the potential by vibrating the electrode and amplifying the increase and decrease of the induced charge as an alternating current, thus measuring the potential. As an alternative, the measuring device may be a rotary sector surface potential measuring device. This is such that a shield electrode is moved into and out of between the electrode and the surface of the photosensitive plate to repeat the creation and disappearance of the induced charge on the electrode and amplify it as an alternating current, thus measuring the potential.

As a further alternative, the measuring device may be one which comprises an FET element disposed in face-to-face relationship with the surface of the photosensitive plate with a shutter interposed therebetween, and a surface potentiometer connected to an amplifier for measuring the surface potential by the same operation as described above.

Figure 19:
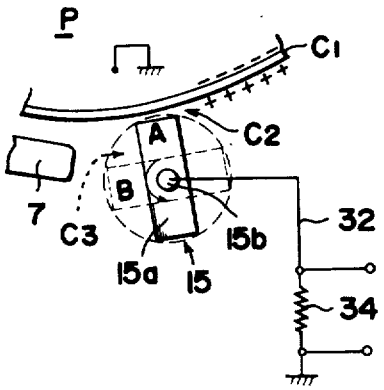
FIG. 19 is an enlarged view of the surface potential measuring device applied in FIG. 18.

FIG. 19 is a detailed, enlarged view of the surface potential measuring device applicable to the present invention. A rotatable electrode 15*a* has a rotary shaft 15*b* parallel to the axis of rotation of the photosensitive drum P. The electode is formed of a conductor material and configured as a rectangular parallelopiped. The electrode 15*a* is insulated from others with the exception that it is connected to a lead wire 32. The lead wire is grounded via a suitable impedance 34. The electrode 15*a* is rotatively driven at a suitable velocity (60–8000 rpm) about its rotary shaft, and by the configuration of the electrode, it has a nearest point A and a remotest point B with respect to the surface of the photosensitive drum during rotation.

Operation of the above-mentioned surface potential measuring device 15 will now be described.

(1) Consider a case that positive potential $V_1$ exists on the surface of the photosensitive drum. Of course, this potential has been formed by the aforementioned electrostatic image formation means. Thus, negative charge is induced on the electrode 15*a*.

Let $C_1$ be the electrostatic capacity of the photosensitive medium, and $C_2$ be the electrostatic capacity at the nearest point A of the electrode 15*a* with respect to the surface of the photosensitive medium. According to the capacity distribution, the potential $V_2$ applied to the capacity $C_2$ is $$V_2 = \frac{C_1}{C_1 + C_2} V_1 \tag{1}$$

However, it should be understood that the electrostatic capacity in this vicinity except the electrode 15*a* and the photosensitive medium P, for example, the electrostatic capacity $C_4$ between the developing electrode 16 and the electrode 15*a*, is negligible.

(2) Let $C_3$ be the electrostatic capacity of the surface of the photosensitive medium and the electrode 15*a* at the remotest point B. According to the capacity distribution, the potential difference applied to this capacity is $$V_3 = \frac{C_1}{C_1 + C_3} V_1 \tag{2}$$

(3) Now, the difference between the amount of charge induced on the electrode 15*a* at the aforementioned points A and B is all supplied through the lead wire 32 and the impedance 34. The amount of charge Q is $$\begin{aligned} Q &= C_2V_2 - C_3V_3 \\ &= \left(\frac{C_1C_2}{C_1 + C_2} - \frac{C_1C_3}{C_1 + C_3}\right) V_1 \\ &= \frac{C_1^2(C_2 - C_3)}{(C_1 + C_2)(C_1 + C_3)} V_1 \end{aligned} \tag{3}$$

Hence, it the capacities $C_1$, $C_2$ and $C_3$ are constant, the surface potential $V_1$ of the photosensitive medium may be measured from equation (3) by measuring the amount of charge Q flowing to the impedance 34.

(4) If $C_1 >> C_2 \approx C_3$, equation (3) can be simplified into $Q \approx (C_2 - C_3)V_1$ (5) Also, if $C_1 >> C_2 >> C_3$, equation (3) can be simplified into $Q \approx C_2V_1$ The above condition $C_1 >> C_2 >> C_3$ means that the current flowing to the impedance 34 is approximately proportional to the product of $C_2$ and $V_1$ when the distance between the electrode 15*a* and the surface of the photosensitive medium is great (e.g. 0.4 mm) as compared with the thickness of the photosensitive medium and the distance between the electrode and the surface of the photosensitive medium at the remotest point B is much greater (e.g. 4 mm) than said first-mentioned distance.

In order to accurately measure $V_1$ under such conditions, it is necessary to minimize the fluctuation of the contrast $C_2$. For this purpose, it is necessary to maintain constant as much as possible the distance between the electrode 15*a* and the surface of the photosensitive medium at the nearest point A. To ensure this, according to the present invention, spacer rollers 30 are rotatably mounted on the shaft of the electrode 15*a* at the opposite ends thereof, as shown in FIG. 20, and the surfaces of these rollers are normally urged against the opposite ends of the surface of the photosensitive drum during measurement.

Figure 20:
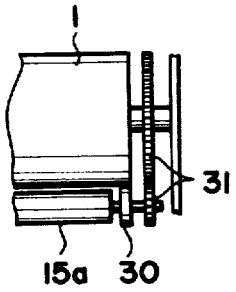
FIG. 20 is a side view of the device shown in FIG. 19.
Figures 21A, 21B, 22C, 22D, 22E:
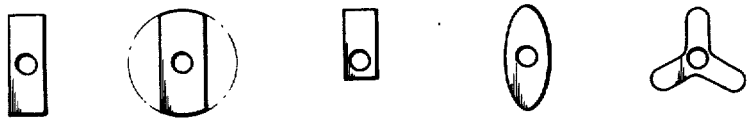

The drive of the electroe 15*a* and the follow of the spacer rollers may be coupled together by the photosensitive drum P and the gear 31 as shown in FIG. 20 (in this case, the drive is very simple), or alternatively the drive and the follow may be separate. FIGS. 21*a*–21*e* shows various examples of the cross-sectional shape adoptable for the electrode 15*a*. FIG. 21*a* is a rectangular parallelopiped, FIG. 21*b* is a partly cut-away cylindrical form, FIG. 21*c* is a shape eccentrically supported such that only one nearest point is provided per rotation, FIG. 21*d* is an elliptical form, and FIG. 21*e* is such that three nearest points are provided per rotation. Other forms may be available.

Figure 23:
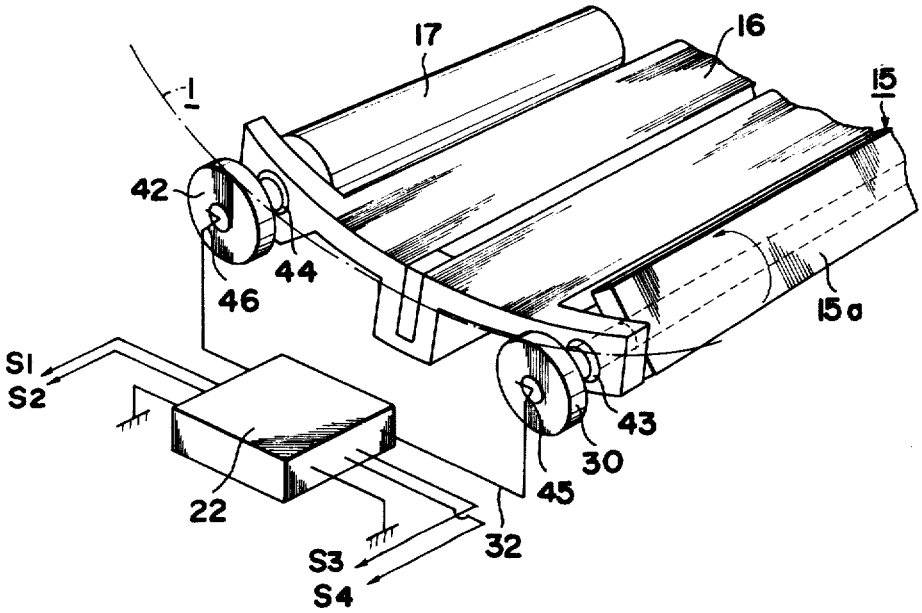
FIG. 23 is an enlarged perspective view of the surface potential measuring device applied in FIG. 18.

FIG. 23 is a perspective view of the above-described measuring device 22 as practically incorporated in a copying apparatus. Measuring electrode 15*a* and its coaxial spacer rollers 30, a defogging roller 17 and its coaxial spacer rollers 42 are all made integral with a developing electrode 16, and these may be urged against the drum P (shown by dash-and-dot line) from therebelow by unshown resilient means or the like, whereby the gaps between the electrode 15*a*, the developing electrode 16, the squeeze roller 17 and the photosensitive drum P may be maintained uniform.

In FIG. 23, reference numerals 43 and 44 designate spacers for insulating the electrode is *a* from the developing electrode. Denoted by 45 and 46 are sliding electrodes engageable with the various support shafts and the sliding electrode 45 receives an electrical signal from the electrode 15*a*, which signal is then amplified to provide the output signal of an amplifier 22 which is representative of the surface potential.

The signal so derived provides, as shown in FIG. 18, a signal S1 for modifying the primary charging voltage source (for making constant the contrast in the first and second embodiments), a development bias signal S2 described with respect to the first embodiment, a signal S3 for modifying the electrostatic image formation secondary charging or discharging voltage source (the second embodiment), or a signal S4 applied to the defogging roller 17 simultaneously with or instead of the development bias.

FIG. 23 also shows an arrangement in which a suitable voltage is applied to the defogging roller 17, by means of the sliding electrode 46, to thereby impart to the roller 17 the defogging action corresponding to the surface potential $V_1$, thus ensuring that a constant image is provided.

Figure 24:
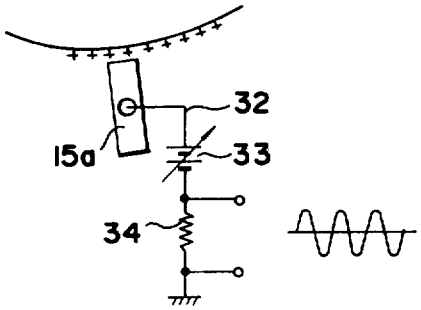
FIGS. 24 and 25 illustrate modifications of the device shown in FIG. 19.

FIG. 24 shows another example of the surface potential measuring device according to the present invention. Lead wire 32 is grounded through a voltage source 33 and an impedance 34 such that when the photosensitive drum potential is the same level as a voltage source 33, no current flows to the impedance but when the photosensitive drum potential differs from the level of the voltage source 33, a current flows to the impedance.

This method is used when the surface potential is adjusted until the current becomes zero with the same potential as a desired surface potential being as the voltage source 33, or when the voltage of the voltage source 33 is varied until the current becomes zero and the surface potential is to be known by reading the voltage of the voltage source 33 at such time.

Figure 25:
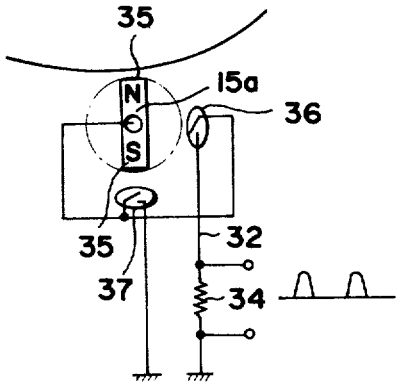

FIG. 25 illustrates an electrical connection in which a magnetic pole 35 is provided on a portion of the electrode 15*a* such that a magnetic switch 36 is operated in synchronism with the magnetic field to flow a current of a specific polarity of the impedance 34.

A current of the opposite polarity is flowed through another magnetic switch 37 to the ground, thereby providing a DC signal.

Figure 26:
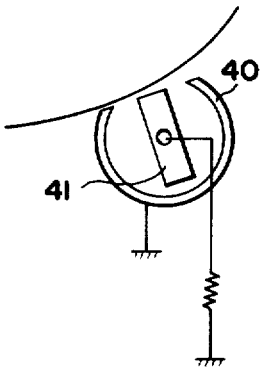
FIG. 26 (PRIOR ART)
FIG. 26 schematically shows the surface potential measuring device according to the prior art.

FIG. 26 shows a conventional example in which a shield electroe 40 having an opening is provided around an electrode 41. As compared with the case as shown in FIG. 24 wherein bias voltage is applied to the electrode 15*a*, this example is not preferable in measurement because the measuring electrode 41*a* is temporally spaced apart from both the shield electrode 40 and the photosensitive medium in the neighborhood of the opening of the shield electrode to permit unnecessary inflow and outflow of the charge. Instead of providing such a shield electrode, a space is positively provided adjacent to the electrode 41 to thereby provide the construction as shown in FIG. 24, thus reducing the earth capacity and enabling highly accurate detection.

Also, in the conventional example of FIG. 26, dust or like material in the air tends to adhere between the gaps adjacent to the shield electrode 40 to thereby cause the concentration of the electric field which would result in short-circuiting, thus providing inaccurate measurement.

Figure 27:
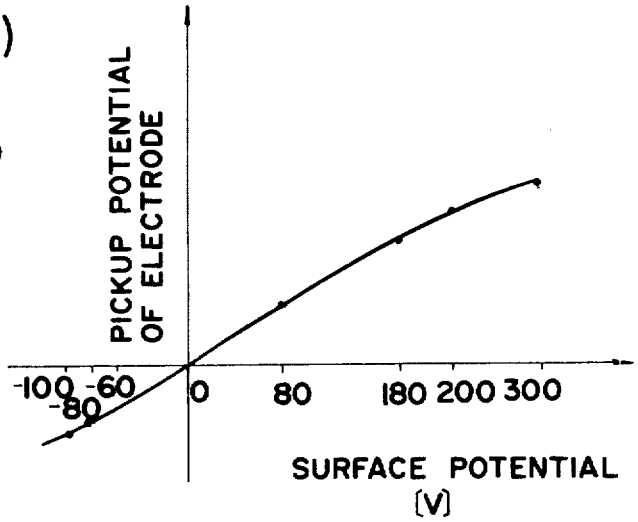
FIG. 27 is a graph showing the result of the actual measurement effected by the surface potential measuring device shown in FIGS. 19, 20 and 23.

FIG. 27 graphically illustrates the relation between the pick-up potential picked up at the impedance connected to the electrode 15*a* in the device of the present invention and the actual surface potential. The surface potential, represented by the abscissa, was measured by a large and complex surface potential measuring device entirely differing in construction from the above-described measuring device having the electrode 15*a*, and there is seen an approximately linear relation between such surface potential and the pick-up potential of the electrode represented by the ordinate. Thus, such a simple electrode type surface potentiometer may be provided on each electrophotographic copying machine in opposed relationship with the photosensitive medium so that immediately after the formation of electrostatic latent image, the surface potential thereof may be measured with the eyes to thereby adjust the chargers or the amount of exposure or the developing device such that the eye-measured potential becomes a proper potential as compared with a predetermined potential, as already noted. Also, the potential after adjusted can be immediately detected by the electrode and therefore, this leads to the provision of an automatically controllable feedback system copying machine which can produce copies of stable and constant quality irrespective of the gradation of the image original to be copied.

What I claim is:

1. A method of stabilizing a contrast value of electrophotographic images comprising the steps of:

forming an electrostatic latent image on an image bearing member by an electrostatic image formation process including charging and image exposure steps applied to the surface of the member;

detecting the light region and the dark region surface potentials of the electrostatic latent image formed on the member;

determining the difference between said light region surface potential and dark region surface potential to obtain an electrostatic contrast value and modifying the charging condition in accordance with the value of said contrast to adjust said electrostatic contrast to a predetermined value; and modifying the background portion potential to a predetermined potential, which would not create fog when said electrostatic image is developed into a visible image, without substantially varying the modified electrostatic contrast.

2. A method according to claim 1, wherein said step of modifying the background portion potential comprises applying a developing bias voltage in relation to the background portion potential of the developed image.

3. A method according to claim 1, wherein said step of modifying the background portion potential comprises controlling a charging voltage applied in relation to the application of image light in the electrostatic image formation process.

4. A method according to claim 1, wherein said step of modifying the background potential comprises controlling an AC discharging voltage applied in relation to the application of image light in the electrostatic image formation process.

5. A method according to claim 1, wherein said step of modifying the background portion comprises applying a bias voltage to means for removing fog after development.

6. A method according to claim 1, wherein the image bearing member includes a photosensitive medium, and further comprising:

the step of controlling the quantity of the image light applied in accordance with the sensitivity of the photosensitive medium on which said electrostatic image is formed.

7. A method accordingly to claim 6, wherein during the step of controlling the quantity of image light, the sensitivity of said photosensitive medium for the standard quantity of light is detected and said quantity of iamge light is adjusted in accordance with said detection.

8. A method of stabilizing a contrast value of electrophotographic images comprising the steps of:

forming an electrostatic latent image on an image bearing member by an electrostatic image formation process including charging and image exposure steps applied to the surface of the member;

detecting the light region and the dark region surface potentials of the electrostatic latent image formed on the member;

determining the difference between said light region surface potential and dark region surface potential to obtain an electrostatic contrast value and modifying the charging condition in accordance with the value of said contrast to adjust said electrostatic contrast to a predetermined value; and modifying the background portion potential to a predetermined potential, which would not create fog when said electrostatic image is developed into a visible image, without substantially varying the modified electrostatic contrast;

wherein said electrostatic image bearing member is a movable drum shaped photosensitive medium, and wherein the step of detecting the surface potential of said image bearing member is preformed by measuring the surface potential and comprises rotating a rotatable electrode in opposed relationship with the surface potential of said photosensitive medium, said electrode having a center of rotation parallel to the support shaft of said photosensitive medium and having a shape in which the electrostatic capacity with respect to the photosensitive medium differs in accordance with the angle of rotation, varying the electrostatic capacity with respect to the potential surface within the range of $C_2-C_3$ ($C_2>C_3$) in accordance with the shape variation of said electrode, wherein $C_2$ and $C_3$ are the electrostatic capacities at the nearest point and the most remote point, respectively, of the electrode with respect to the photosensitive medium, said electrode being disposed so that the ground capacity $C_4$ of said electrode excepting said photosensitive medium satisfies $C_4<<C_2$, rendering the charge Q induced in said electrode substantially equal to the product of constants $C_1$, $C_2$ and $C_3$ and the surface potential $V_1$ of the photosensitive medium, to thereby measure the surface potential $V_1$ of said photosensitive medium, wherein $C_1$ is the electrostatic capacity of the potential surface of said photosensitive medium.

9. A method according to claim 8, wherein said electrode is disposed so that its maximum capacity $C_2$ satisfies the relation $C_2<<C_1$, whereby said charge Q satisfies $Q\approx(C_2-C_3)V_1$, thereby measuring the surface potential of the photosensitive medium.

10. A method according to claim 9, wherein said electrode is disposed so that its minimum capacity $C_3$ satisfies the relation $C_3<<C_2$, whereby said charge Q satisfies $Q\approx C_2V_1$, thereby measuring the surface potential of said photosensitive medium.

11. A method of stabilizing a contrast value of electrophotographic images comprising the steps of:

forming an electrostatic latent image on an image bearing member by an electrostatic image formation process including charging and image exposure steps applied to the surface of the member;

detecting the light region and the dark region surface potentials of the electrostatic latent image formed on the member;

determining the difference between said light region surface potential and dark region surface potential to obtain an electrostatic contrast value and modifying the charging condition in accordance with the value of said contrast to adjust said electrostatic contrast to a predetermined value; and modifying the background portion potential to a predetermined potential, which would not create fog when said electrostatic image is developed into a visible image, without substantially varying the modified electrostatic contrast;

wherein said electrostatic image bearing member is a movable drum shaped photosensitive medium, and wherein the step of detecting the surface potential of said image bearing member is performed by measuring the surface potential and comprises providing a rotatable electrode having a rotary shaft parallel to the shaft of the movable photosensitive medium and having a shape in which the electrostatic capacities $C_2$ and $C_3$ at the nearest point and the most remote point, respectively, of the electrode with respect to the surface of the photosensitive member differ ($C_2 > C_3$) in accordance with the angle of rotation, said electrode being disposed in a spaced apart relationship with various elements disposed around said electrode so that the ground capacity $C_4$ of the electrode excepting the photosensitive medium is negligible with respect to $C_2$, whereby $C_4$ does not substantially affect the charge induced on said electrode.

12. A method of stabilizing a contrast value of electrophotographic images comprising the steps of:

forming an electrostatic latent image corresponding to the light and dark regions of an original by an electrostatic image formation process including charging and image exposure steps;

measuring the light region and the dark region potentials of said electrostatic latent image formed on the member;

determining the difference between said light region potential and said dark region potential to obtain an electrostatic contrast value and modifying the charging condition in accordance with the value of said contrast to adjust said electrostatic contrast to a predetermined value;

adjusting the light or the dark region of the electrostatic image under said modified condition;

measuring the light or the dark region potential of said adjusted image; and controlling a bias voltage during development of said adjusted image in accordance with said last-measured light or said dark region potential.

13. A method according to claim 12, wherein the step of modifying the electrostatic contrast to a predetermined value includes comparing the electrostatic contrast obtained from the potential difference between said light and dark regions with a predetermined contrast and automatically controlling the charging condition in a direction in which the two contrasts are coincident.

14. A method according to claim 12, wherein the step of modifying the electrostatic contrast to a predetermined value includes charging to adjust the electrostatic contrast obtained from the potential difference between the light and dark regions to a predetermined contrast by the use of a predetermined contrast-charging voltage conversion means.

15. A method according to claim 12, wherein the step of controlling the bias voltage includes applying to the developing electrode a bias voltage substantially eliminating background portion fog without substantially varying the once modified electrostatic contrast.

16. A method of stabilizing a contrast value of electrophotographic images comprising the steps of:

forming an electrostatic latent image by an electrostatic image formation process including primary charging and secondary charging or discharging and image exposure steps;

measuring the light region and the dark region potential of said electrostatic latent image;

determining the difference between said two potentials to thereby obtain an electrostatic contrast value and modifying the primary charging condition in accordance with the value of the contrast to thereby adjust said electrostatic contrast to a predetermined value;

forming an electrostatic image under the said modified condition;

measuring the potential of the light or the dark region of said reformed electrostatic image; and controlling the secondary charging or discharging condition in accordance with the last-measured value to thereby adjust the light or the dark region potential to a predetermined value.

17. A method of stabilizing a contrast value of electrophotographic images comprising the steps of:

forming an electrostatic latent image on a photosensitive medium by an electrostatic image formation process including primary charging and secondary charging or discharging and exposure steps;

measuring the light region and the dark region potential of said electrostatic latent image formed on the member;

determining the difference between said two potentials to thereby obtain an electrostatic contrast value and modifying the primary charging condition in accordance with the value of the contrast to thereby adjust said electrostatic contrast to a predetermined value;

reforming an electrostatic image under said modified condition;

measuring the potential of a light and dark region of said reformed electrostatic image;

controlling the secondary charging or discharging condition in accordance with the last-measured value to thereby adjust the light or the dark region potential to a predetermined value; and adjusting the amount of exposure so as to impart a proper quantity of light in accordance with the photosensitive medium used.

18. An apparatus for stabilizing a contrast value of electrophotographic images comprising:

means for uniformly charging a movable photosensitive medium;

means for imparting image light to the charged surface of said photosensitive medium to thereby provide an electrostatic latent image thereon;

means for detecting the light region and the dark region surface potentials of the electrostatic image formed on said photosensitive medium;

means for determining the difference bewteen said detected surface potentials to obtain an electrostatic contrast value and for modifying the charging condition in accordance with the value of said contrast to adjust the electrostatic contrast to a predetermined value;

means for modifying the background portion potential, without substantially varying the modified electrostatic contrast, to a potential which would not create fog from a developer when the electrostatic image is developed; and means for developing the electrostatic image having a predetermined electrostatic contrast by the use of developer.

19. An apparatus for stabilizing a contrast value of electrophotographic images comprising:

means for uniformly charging a movable photosensitive medium;

means for imparting image light to the charged surface of said photosensitive medium to thereby provide an electrostatic latent image thereon;

means for detecting the light region and the dark region surface potentials of the electrostatic image formed on said photosensitive medium;

means for determining the difference between said detected surface potentials to obtain an electrostatic contrast value and for modifying the charging condition in accordance with the value of said contrast to adjust the electrostatic contrast to a predetermined value;

means for modifying the background portion potential, without substantially varying the modified electrostatic contrast, to a potential which would not create fog from a developer when the electrostatic image is developed; and means for developing the electrostatic image having a predetermined electrostatic contrast by the use of developer;

wherein said photosensitive medium is drum shaped and supported on a shaft, and said means for detecting the surface potentials includes a rotatable electrode in opposed relationship with the surface of said photosensitive medium, said electrode having an axis of rotation parallel to the support shaft of said photosensitive medium and having a shape in which the electrostatic capacities $C_2$ and $C_3$ at the nearest point and the most remote point, respectively, of the electrode with respect to the surface of the photosensitive medium, differ in accordance with the angle of rotation, and means for spacing said electrode apart from various elements disposed around said electrode so as to enable the ground capacity $C_4$ of said electrode excepting the photosensitive medium to be negligible as compared with $C_2$, and for maintaining a constant separation between the electrode and the surface of said photosensitive medium.

20. A method for stabilizing a contrast value of images comprising the steps of:

forming an electrostatic latent image on an image bearing member by an electrostatic image formation process including charging and image exposure steps applied to the surface of the member;

detecting a difference between the light region surface potential and the dark region surface potential of the electrostatic latent image on the member to obtain an electrostatic contrast value;

modifying the charging conditions in accordance with the detected value of said contrast to adjust said electrostatic contrast to a predetermined value; and modifying the background portion potential to a predetermined potential to prevent background development without substantially varying the modified electrostatic contrast.

* * * * *